US008602550B2

(12) United States Patent
Idei et al.

(10) Patent No.: US 8,602,550 B2
(45) Date of Patent: Dec. 10, 2013

(54) COATED PRINTING PAPER

(75) Inventors: Koji Idei, Tokyo (JP); Hiroo Kaji, Tokyo (JP); Hiroshi Matsuda, Tokyo (JP); Masanori Nagoshi, Tokyo (JP); Kazutoshi Iida, Tokyo (JP); Jun Urasaki, Tokyo (JP)

(73) Assignee: Mitsubishi Paper Mills Limited, Tokyo (JP)

( * ) Notice: Subject to any disclaimer, the term of this patent is extended or adjusted under 35 U.S.C. 154(b) by 0 days.

(21) Appl. No.: 13/381,686

(22) PCT Filed: Jun. 29, 2010

(86) PCT No.: PCT/JP2010/061010
§ 371 (c)(1),
(2), (4) Date: Dec. 30, 2011

(87) PCT Pub. No.: WO2011/001955
PCT Pub. Date: Jan. 6, 2011

(65) Prior Publication Data

US 2012/0107531 A1 May 3, 2012

(30) Foreign Application Priority Data

| | | |
|---|---|---|
| Jul. 3, 2009 | (JP) | 2009-158592 |
| Jul. 17, 2009 | (JP) | 2009-169533 |
| Jan. 8, 2010 | (JP) | 2010-002577 |
| Mar. 25, 2010 | (JP) | 2010-070674 |

(51) Int. Cl.
*B41J 2/01* (2006.01)
*B41M 5/40* (2006.01)

(52) U.S. Cl.
USPC ..... 347/105; 428/32.31; 428/32.35

(58) Field of Classification Search
USPC ..... 347/105; 428/32.31, 32.35
See application file for complete search history.

(56) References Cited

U.S. PATENT DOCUMENTS

| | | | |
|---|---|---|---|
| 5,616,409 | A | 4/1997 | Matsuda et al. |
| 2007/0286970 | A1 | 12/2007 | Ogino et al. |

FOREIGN PATENT DOCUMENTS

| | | | |
|---|---|---|---|
| JP | 3-43290 | A | 2/1991 |
| JP | 5-254239 | A | 10/1993 |
| JP | 8-324102 | A | 12/1996 |
| JP | 2002-347328 | A | 12/2002 |
| JP | 2005-88482 | A | 4/2005 |
| JP | 2005-153221 | A | 6/2005 |
| JP | 2006-247863 | A | 9/2006 |
| JP | 2006-297781 | A | 11/2006 |
| JP | 2007-185780 | A | 7/2007 |
| JP | 2007-333794 | A | 12/2007 |
| JP | 2008-297679 | A | 12/2008 |
| JP | 2009-23292 | A | 2/2009 |
| JP | 2009-138317 | A | 6/2009 |

OTHER PUBLICATIONS

Machine Translation of JP 2009-138317.*
Machine Translation of JP 2008-297679.*
Machine Translation of JP 08-324102.*

* cited by examiner

*Primary Examiner* — Gerard Higgins
*Assistant Examiner* — Sathavaram I Reddy
(74) *Attorney, Agent, or Firm* — Birch, Stewart, Kolasch & Birch, LLP

(57) ABSTRACT

A coated printing paper has a favorable offset printability, which can achieve good ink fixing and ink absorption properties even in ink jet printing, which has suitable dot diffusion even when printed by an ink jet printer using pigment ink, and can prevent the occurrence of white lines. The coated printing paper comprises a base paper and a coating layer which is applied to at least one surface of the base paper and contains a pigment and a binder as major components, wherein the base paper comprises a cationic compound, the coating layer contains, as a pigment, 50 parts by mass or more of ground calcium carbonate based on 100 parts by mass of total pigments in the coating layer, and the applied amount of the coating layer is 2.0 g/m$^2$ to 7.0 g/m$^2$, both inclusive, per surface.

8 Claims, No Drawings

COATED PRINTING PAPER

TECHNICAL FIELD

The present invention relates to a coated printing paper. Specifically, the invention relates to a coated printing paper having a favorable printability also for ink jet printing without its printability for offset printing being impaired, and having a texture close to CWF matt coated paper.

BACKGROUND ART

Due to rapid development in ink jet recording technology, it has become possible to form a colored and high quality image on a recording medium such as paper and film by printers using ink jet recording system. Such printers using ink jet recording system vary from small size printers for home use to wide-format printers used by printing companies and so forth. Since printing is basically performed on a one sheet-by-one sheet basis, these printers were mainly used at printing sites where a small number of copies was required.

In recent years, because of further development of the technology, application of ink jet recording system to commercial printing (hereinafter referred to as "ink jet printing") has been started. In the commercial printing field, the number of copies to be printed is large and in the light of the balance between productivity and printing cost, printing speed is valued. Printing speed suitable for ink jet printing is achieved by a printing machine comprising a line scan head to which heads for ejecting ink are fixed such that they cover the entire cross direction intersecting at right angles with the machine direction (hereinafter referred to as "ink jet printing machine") (see, for example, Patent Document 1). Furthermore, rotary-type ink jet printing machines with a printing speed of 15 m/min or more, those with a higher speed of 60 m/min or more, and those with a speed exceeding 120 m/min have also been developed recently.

Since ink jet printing machines can deal with variable information, they are applied particularly to on-demand printing. It is preferred in commercial printing that fixed information be printed by an offset printing machine, and that variable information be printed by an ink jet printing machine.

When conventional offset coated printing paper was used for an ink jet printing machine, however, there were following problems: due to poor ink fixing and absorption properties of the offset coated printing paper with respect to the ink jet ink, printed images printed at the aforementioned speeds rubbed-off and stained during handling of the paper after printing, and uneven ink absorption and bleeding also occurred.

When the amount of binder in the coating layer is simply reduced or the amount of porous pigment in the coating layer is simply increased in order to improve ink fixing and ink absorption properties in ink jet printing, layer strength of the coating layer can be lost and blanket piling can occur, i.e., the offset printability of the coated printing paper is impaired. Therefore, coated printing paper is required to have ink jet printability including sufficient ink fixing and ink absorption properties without losing its offset printability.

In view of weather resistance, ink jet printing machines which use pigment ink as ink jet ink are increasing. As problems of pigment ink, poor dot diffusion and poor abrasion resistance can be mentioned. "Poor dot diffusion" refers to a phenomenon of insufficient ink spreading in a planar direction during the process in which ink jet ink collides with and is absorbed by coated printing paper. As a result of poor dot diffusion, streaky areas, i.e., white lines where overlapping of inks is insufficient, appear on the printed image. It is therefore necessary to inhibit poor dot diffusion. "Poor abrasion resistance" refers to a phenomenon where pigment ink comes off from a printed portion of a coated printing paper by being rubbed with something. Due to such poor abrasion resistance, smudges occur on printed image. It is therefore necessary to improve abrasion resistance property.

Papers exclusive for ink jet recording system in which porous pigments having a high BET specific surface are applied to a base paper (see, for example, Patent Document 2 and Patent Document 3), are excellent in ink fixing and ink absorption properties in ink jet printing. These exclusive papers for ink jet recording system, however, tend to produce white lines, and their offset printability is poor.

As exclusive paper for ink jet recording system having a good ink absorption property for pigment ink, there exist following exclusive papers for ink jet recording system: those having a coating layer containing inorganic particles having a mean particle size of less than 2.5 μm and having a mean particle size of 2.5 μm or more to less than 5 μm (see, for example, Patent Document 4); and those comprising as a first component at least two kinds of colloidal silica each having a different average primary particle size (see, for example, Patent Document 5). These exclusive papers for ink jet recording system, however, cannot be used for offset printing. Furthermore, they are poor in terms of ink fixing property even in ink jet printing, leading to occurrence of poor dot diffusion.

As recording papers whose contact angle and droplet absorption time are specified, there are following exclusive papers for ink jet recording system: those having an absorbed amount of 0.15 μl or more and a contact angle of 50° or more of 2 μl of pure water, after 5 seconds of dropping thereof (see, for example, Patent Document 6); those having a contact angle of 40° to 80°, both inclusive, of water, after 0.04 second (see, for example, Patent Document 7); those having a contact angle of 10° to 30°, both inclusive, of deionized water after 0.5 second (see, for example, Patent Document 8); those having an absorption time of 60 seconds or less of 5 μl of a liquid having a surface tension of 40 mN/m and a contact angle of 50° to 80°, both inclusive, of the same liquid after 0.1 second (see, for example, Patent Document 9). These exclusive papers for ink jet recording system whose contact angle and liquid absorption time are specified, however, are for a printer which performs printing on a one sheet-by-one sheet basis, and thus they fail to have sufficient ink jet printability required in the commercial printing field.

[Patent Document 1] Japanese Laid-open Patent [Kokai] Publication No. 2009-23292
[Patent Document 2] Japanese Laid-open Patent [Kokai] Publication No. Hei 3-43290 (1991)
[Patent Document 3] Japanese Laid-open Patent [Kokai] Publication No. Hei 5-254239 (1993)
[Patent Document 4] Japanese Laid-open Patent [Kokai] Publication No. 2006-247863
[Patent Document 5] Japanese Laid-open Patent [Kokai] Publication No. 2006-297781
[Patent Document 6] Japanese Laid-open Patent [Kokai] Publication No. 2007-185780
[Patent Document 7] Japanese Laid-open Patent [Kokai] Publication No. 2005-88482
[Patent Document 8] Japanese Laid-open Patent [Kokai] Publication No. 2005-153221
[Patent Document 9] Japanese Laid-open Patent [Kokai] Publication No. 2002-347328

DISCLOSURE OF INVENTION

Problem to be Solved by the Invention

No coated printing paper which can satisfy ink jet printability without losing its offset printability has been provided. In particular, there is no coated printing paper, which is, without losing its offset printability, suitable for ink jet printing machines which employ pigment ink.

That is, the purport of the present invention is to provide a coated printing paper satisfying the following objects: (1) having a good offset printability; (2) having sufficient ink fixing and ink absorption properties in ink jet printing as well; (3) being capable of preventing poor dot diffusion when printed by an ink jet printing machine which employs pigment ink; and (4) having a good abrasion resistance property of printed portions in ink jet printing which employs pigment ink.

Means for Solving the Problem

The aforementioned objects can be achieved by a coated printing paper comprising a base paper and a coating layer which is applied to at least one surface of the base paper and contains a pigment and a binder as major components, wherein the base paper comprises a cationic compound; the coating layer contains, as a pigment, 50 parts by mass or more of ground calcium carbonate based on 100 parts by mass of total pigments in the coating layer; and the applied amount of the coating layer is 2.0 g/m$^2$ to 7.0 g/m$^2$, both inclusive, per surface.

In the present invention, the cationic compound may be a cationic resin, whereby favorable ink fixing and ink absorption properties can be achieved.

In the present invention, the cationic compound may be a multivalent cation salt, whereby favorable ink fixing and ink absorption properties can be achieved.

In the present invention, the ground calcium carbonate contained as a pigment in the coating layer may have a particle size distribution where the cumulative frequency of a particle with the size of 2 μm or less is 70% or less, whereby poor dot diffusion can be inhibited.

In the present invention, the base paper may have an ash content of 10 mass % or more, whereby favorable ink absorption can be achieved.

Another preferred embodiment of the present invention is a coated printing paper comprising a base paper and a coating layer which is applied to at least one surface of the base paper and contains a pigment and a binder as major components, wherein the contact angle of a mixture solution of deionized water and glycerine (deionized water/glycerine=8/2) on a surface of the coating layer is 85° to 110°, both inclusive, after 0.1 second of contact, and 65° to 90°, both inclusive, after 1.5 seconds of contact, and the surface of the coating layer has a gloss degree in which 75° gloss according to JIS Z8741 is less than 40%, whereby the objects can be achieved.

In the coated printing paper having the aforementioned contact angles, when 1 μl droplet of a mixture solution of deionized water and glycerine (deionized water/glycerine=8/2) is added dropwise to the surface of the coating layer, the volume fraction of the remaining droplet after 1.5 seconds may be 85% to 100%, both inclusive, and the volume fraction of the remaining droplet after 10 seconds may be 70% to 90%, both inclusive, whereby a favorable ink fixing property can be achieved and poor dot diffusion can also be inhibited.

As yet another preferred embodiment of the present invention, provided is a printing method using an ink jet printing machine, comprising the steps of obtaining the aforementioned coated printing paper, and performing ink jet printing using a pigment ink on the coating layer of the coated printing paper at a printing speed of 50 m/min or more to form a printed image. Furthermore, the present invention provides a method for forming an excellent printed image, comprising the steps of obtaining the aforementioned coated printing paper and forming a printed image on the coating layer of the coated printing paper using an offset printing machine and/or an ink jet printing machine.

Effect of the Invention

According to the present invention, it is possible to obtain a coated printing paper having a favorable offset printability as well as favorable ink fixing and ink absorption properties also in ink jet printing. Furthermore, it is possible to obtain a coated printing paper on which dots properly diffuse and the occurrence of white lines can be prevented, and, in addition, which is excellent in abrasion resistance property of the printed portion, even when an ink jet printing machine loaded with pigment ink is used.

BEST MODE FOR CARRYING OUT THE INVENTION

The coated printing paper according to the present invention will be described in detail below.

As a base paper used for the coated printing paper of the present invention, there can be mentioned papers made under the acidic, neutral, or alkaline condition from paper stock obtained from chemical pulp such as LBKP and NBKP, mechanical pulp such as GP, PGW, RMP, TMP, CTMP, CMP and CGP, and recycled paper pulp such as DIP, to which are added various fillers such as precipitated calcium carbonate, ground calcium carbonate, talc, clay and kaolin, as well as various additive agents such as sizing agents, fixing agents, retention aids, cationic compounds, and paper strengthening additives as necessary.

In the present invention, other additive agents may be added to the paper stock within the scope not impairing the desired effect of the present invention, and such additive agents include: pigment dispersants, thickening agents, fluidity improving agents, defoamers, antifoamers, releasing agents, foaming agents, penetrating agents, coloring dyes, color pigments, optical brighteners, ultraviolet absorbing agents, antioxidants, preservatives, fungicides, insolubilizers, wet paper strengthening additives and dry paper strengthening additives.

In the present invention, the base paper may have any degree of sizing so long as the desired effect of the present invention is not impaired, and the sizing degree can be adjusted depending on the amount of the internal sizing agent and the amount of the surface sizing agent to be applied on the base paper. The internal sizing agent, for example, is a rosin-based sizing agent for acidic paper, and for neutral paper, alkenyl succinic anhydride, alkyl ketene dimer, a neutral rosin-based sizing agent or a cationic styrene-acrylic sizing agent, or the like. The surface sizing agent, for example, is a styrene-acrylic sizing agent, an olefinic sizing agent a styrene-maleic sizing agent, or the like. When, in particular, the surface sizing agent is applied with a later-described cationic compound, a cationic or nonionic surface sizing agent is preferable. The content of the sizing agent in the base paper as the internal sizing agent is preferably 0.01 to 1.0 mass %, both inclusive, and more preferably 0.03 to 0.8 mass %, both inclusive, with respect to the pulp mass. The amount of content of the surface sizing agent to be applied on the base paper is preferably 0.01 g/m$^2$ to 1.0 g/m$^2$, both inclusive, and more preferably 0.02 g/m$^2$ to 0.5 g/m$^2$, both inclusive.

In the view of the absorptivity of the ink jet ink, the ash content in the base paper is preferably 10 mass % or more. When the ash content is less than 10 mass %, uneven ink absorption can occur. When the ash content exceeds 25 mass %, troubles such as picking and paper break attributable to poor strength of the base paper can occur during offset printing.

The "ash content" as used herein refers to the ratio of the mass of incombustibles after one-hour combustion treatment of a base paper at 500° C. with respect to the absolute dry mass of the base paper before the combustion treatment (mass %). The ash content can be adjusted depending on the content of fillers in the base paper.

In the present invention, the base paper contains a cationic compound. By containing a cationic compound, the coated printing paper can possess ink fixing and ink absorption properties suitable for ink jet printing. Although the reason therefor is not clear, it is considered that mild aggregation occurs in a coating colour in the vicinity of the interface between the base paper and the coating colour when a coating layer is formed on the base paper, resulting in a porous structure of the coating layer in the vicinity of the base paper.

In the present invention, the cationic compound is a cationic resin or a multivalent cation salt. The cationic resin is a commonly used cationic polymer or cationic oligomer, and their types are not particularly limited. Preferable cationic resins are polymers or oligomers containing primary to tertiary amines or quaternary ammonium salt in which protons easily coordinate and which exhibit a cationic property as a result of dissociation when dissolved in water. Specific examples thereof include, for example, compounds such as polyethyleneimine, polyvinylpyridine, polyamine sulfone, polydialkylaminoethylmethacrylate, polydialkylaminoethylacrylate, polydialkylaminoethylmethacrylamide, polydialkylaminoethylacrylamide, polyepoxyamine, polyamideamine, dicyandiamide-formalin condensate, dicyandiamidepolyalkyl-polyalkylenepolyamine condensate, polyvinylamine, polyallylamine and a hydrochloride thereof; a copolymer of polydiallyldimethyl ammonium chloride and acrylamide, and a copolymer of diallyldimethyl ammonium chloride and acrylamide; polydiallylmethylamine hydrochloride, polymethacrylatemethyl chloride quaternary salt, dimethylamine-ammonia-epichlorohydrin condensate, and dimethylamine-epichlorohydrin condensate, and the like, but are not limited to those. In the present invention, while the mean molecular weight of the cationic resin is not particularly limited, it is preferably 500 to 20,000, both inclusive, more preferably 1,000 to 10,000, both inclusive.

The "multivalent cation salt" as used herein refers to a salt containing a water-soluble multivalent cation, preferably a salt containing a multivalent cation having a solubility of 1 mass % or more in water at 20° C. Examples of the multivalent cation include, for example, bivalent cations such as magnesium, calcium, strontium, barium, nickel, zinc, copper, iron, cobalt, tin, and manganese; trivalent cations such as aluminum, iron and chrome; or quaternary cations such as titanium and zirconium; as well as their complex ion thereof. As anion which forms a salt with a multivalent cation, either inorganic acid or organic acid may be used, and not particularly limited. As the inorganic acid, there can be mentioned, without limitation, hydrochloric acid, nitric acid, phosphoric acid, sulfuric acid, boric acid and hydrofluoric acid. As the organic acid, there can be mentioned, without limitation, formic acid, acetic acid, lactic acid, citric acid, oxalic acid, succinic acid, and organic sulfonic acid. As a preferable multivalent cation salt, magnesium chloride and calcium chloride can be mentioned.

The amount of the cationic compound to be contained in the base paper is preferably in the range of 1.0 g/m$^2$ to 3.0 g/m$^2$, both inclusive, in terms of attached solid content. When the amount is less than this range, sufficient ink fixing and ink absorption properties may not be achieved. If the amount is greater than this range, there is no more effect of improving the ink fixing and ink absorption properties, and thus it is not preferable in terms of cost.

As the method for causing the base paper to contain a cationic compound, there are a method of making paper after a cationic compound is contained in paper stock of a base paper, and a method of applying a cationic compound on a base paper or impregnating a base paper with a cationic compound and so forth. In view of the fact that the coating layer in the vicinity of the base paper forms a porous structure, the method of applying a cationic compound on the base paper or impregnating the base paper with a cationic compound is preferable. As the applying method, methods of coating using various coating machines such as size presses, gate roll coaters, film transfer coaters, and in addition, blade coaters, rod coaters, air knife coaters, and curtain coaters can be employed. In view of the manufacturing cost, preferred are on-machine coating methods using size presses, gate roll coaters and film transfer coaters mounted on paper making machines.

Also possible is a technique of causing a coating layer to contain a cationic compound as applied in exclusive paper for ink jet recording system. By merely causing a coating layer to contain a cationic compound, however, it is not possible to achieve sufficient ink fixing and ink absorption properties for a high-speed ink jet printing. As a result of the base paper containing a cationic compound, a coated printing paper can achieve favorable ink fixing and ink absorption properties for a high-speed ink jet printing. It should be noted that so long as the base paper contains a cationic compound, a coating layer may contain a cationic compound as necessary.

While the thickness of the base paper in the present invention is not particularly limited, it is 50 to 300 μm, both inclusive, and preferably 80 to 250 μm, both inclusive.

The coated printing paper of the present invention has a coating layer containing a pigment and a binder as major components on a base paper. By applying a coating layer, it is possible to differentiate it from woodfree paper in terms of printing quality and appearance.

Porous pigments such as synthesized silica used for a coating layer in the exclusive paper for ink jet recording system can absorb ink jet ink. Kaolin and calcium carbonate used for the coating layer of general coated printing paper, however, hardly absorb ink jet ink because their particles per se are not porous.

In the present invention, the coating layer contains ground calcium carbonate as a pigment. The content of ground calcium carbonate in the coating layer is 50 parts by mass or more, and preferably 60 parts by mass to 95 parts by mass, both inclusive, based on 100 parts by mass of total pigments in the coating layer. The particles of ground calcium carbonate per se have no property of absorbing ink jet ink. Ink jet ink, however, can be absorbed by the voids formed among particles, the formation being attributable to amorphous ground calcium carbonate particles. As a result of the fact that the coating layer contains 50 parts by mass or more of ground calcium carbonate in 100 parts by mass of total pigments in the coating layer, it is possible to achieve ink jet printability without impairing its offset printability. When the content of ground calcium carbonate in the coating layer is less than 50 parts by mass, formation of voids in the coating layer is insufficient, and thus ink jet printability cannot be achieved.

In the present invention, ground calcium carbonate preferably has a particle size distribution where the cumulative frequency of particles with the size of 2 μm or less is 70% or less. Due to the fact that the ground calcium carbonate has a particle size distribution where a cumulative frequency of particles with the size of 2 μm or less is 70% or less, suitable voids are formed in the coating layer, with the result that there is no occurrence of white lines due to poor dot diffusion, and that a more favorable print quality is achieved. Ground calcium carbonate having such a particle size distribution can be prepared by general grinding and size separation, and are also commercially available.

"Particle size distribution" as used herein refers in principle to a particle size distribution based on the volume measured by a laser diffraction/scattering type particle size analyzer. In one embodiment of the present invention, as laser diffraction/scattering type particle size analyzer, a laser diffraction/scattering type particle size distribution measuring apparatus, Microtrac MT3000II manufactured by Nikkiso Co., Ltd. is used. When calculating a particle size distribution of ground calcium carbonate from a coated printing paper, the particle size distribution of ground calcium carbonate of a coated printing paper can be calculated, for example, by taking an electron micrograph of the surface of the coated printing paper using a scanning electron microscope, assuming the particles in the obtained image as spheres having close areas to them, and measuring the particle sizes to obtain the particle size distribution.

Furthermore, as a result of the study of appearance and ink fixing property of coated printing paper, it was found that when the applied amount of the coating layer of a coated printing paper on one surface is limited to 2.0 g/m$^2$ to 7.0 g/m$^2$, both inclusive, both offset printability and ink jet printability can be achieved. As used herein, "the applied amount" of the coating layer refers to the applied amount in terms of solid content.

When the applied amount of the coating layer is less than 2.0 g/m$^2$, ink fixing is favorable, but sheet appearance deteriorates and becomes closer to that of general woodfree paper. When the applied amount of the coating layer exceeds 7.0 g/m$^2$, sheet appearance is favorable, but ink fixing property decreases.

In the coating layer of the present invention, conventionally and publicly known pigments may be used as pigments in addition to the above-mentioned ground calcium carbonate. As such pigments, there can be mentioned, for example, inorganic pigments such as kaolin, precipitated calcium carbonate, clay, talc, sulfuric acid calcium, sulfuric acid barium, titanium dioxide, zinc oxide, zinc sulfide, zinc carbonate, satin white, aluminum silicate, diatomaceous earth, calcium silicate, magnesium silicate, synthesized silica, aluminium hydroxide, alumina, lithopone, zeolite, magnesium carbonate, and magnesium hydroxide; and organic pigments such as styrene-based plastic pigment, acrylic plastic pigment, polyethylene, microcapsule, urea resin, and melamine resin.

When, however, porous pigments having a high oil absorbency, as represented by synthesized silica, are heavily used, poor dot diffusion can occur, or the strength of the coating layer may lower. When strength of the coating layer decreases, troubles such as blanket piling in offset printing are caused, and the average oil absorption by the pigments used in the coating layer is preferably 100 g/100 g pigment or less.

Furthermore, in the present invention, since the applied amount of the coating layer per surface is as little as 2.0 g/m$^2$ to 7.0 g/m$^2$, both inclusive, a plastic pigment having a high gloss expression capability can suitably be used to adjust the gloss so as to increase the gloss to some extent.

In yet another embodiment of the present invention, the mean particle size of respective pigments used for the coating layer of the coated printing paper is preferably selected from the range of 0.1 μm to 5 μm, both inclusive. More preferably, the pigments include two or more types of pigments different from each other in terms of mean particle size, wherein the mean particle size of smaller pigment with respect to the mean particle size of larger pigment sequentially satisfies the following Equation (1). Here the "two or more types" includes the same kinds of pigments having different mean particle sizes from each other.

$$R(a)=0.4\cdot R(A) \text{ to } 0.7\cdot R(A) \qquad \text{Equation (1)}$$

R(A): mean particle size of larger pigment

R(a): mean particle size of smaller pigment

With pigments having a larger mean particle size than the aforementioned range, poor dot diffusion can be inhibited, but ink fixing and ink absorption properties may not be achieved. On the other hand, with pigments having a smaller mean particle size than the aforementioned range, ink fixing and ink absorption properties are favorable, but poor dot diffusion can occur or the strength of the coating layer may not be achieved. When the pigments include two or more types of pigments having different mean particle sizes from each other, and, at the same time, the two or more types of pigments satisfy the Equation (1) above, excellent ink fixing and ink absorption properties as well as inhibition of poor dot diffusion can be achieved.

For example, when pigments include three types of pigments differing in mean particle size, a first pigment having the largest mean particle size and a second pigment having the second largest mean particle size satisfy the Equation (1) above, and the second pigment having the second largest mean particle size and a third pigment having the third largest mean particle size satisfy the Equation (1) above.

As a pigment having the largest mean particle size satisfying the Equation (1) above, kaolin is preferable. By using kaolin, more favorable ink absorption can be achieved. It is preferred that the Equation (1) above be satisfied between inorganic pigment particles.

In one embodiment of the present invention, the mean particle sizes of the respective pigments used in the coating layer are calculated from the particle size distribution measured by laser diffraction/scattering type particle size distribution measuring apparatus, Microtrac MT3000II manufactured by Nikkiso Co., Ltd. A cumulative frequency curve for the particle sizes of pigments is obtained from the measured results of particle size distribution, and the particle size at the point of cumulative frequency of 50% is regarded as the mean particle size.

Pigments having a mean particle size in the range of 0.1 μm to 5 μm, both inclusive, can be purchased as commercial products from Shiraishi Calcium Kaisha, Ltd., Hyogo Clay K. K., Fimatec Ltd., Okutama Kogyo Co., Ltd., Engelhard Corporation, Huber & Co. Ltd., IMERYS Pigments for Paper & Packaging, Tokuyama Corporation, Mizusawa Industrial Chemicals, Ltd., Tosoh Silica Corporation, W. R. Grace & Co.—Conn., Shionogi & Co., Ltd, etc. It is also possible to obtain a desired mean particle size as needed from a pigment having a relatively large mean particle size by a method for microperticulation using a strong force of a mechanical means. As such mechanical means, there can be mentioned ultrasound homogenizers, pressure type homogenizers, liquid flow-impingement homogenizers, high-speed rotation mills, roller mills, container driving medium mills, wet medium stirring mills, jet mills, mortars, Raikai Machine or automated mortar (a device for grinding and kneading a subject to be ground in a bowl-like container with a pestle-like stirring rod), and sand grinders. Classification and circuit grinding can be carried out to make particle size smaller.

The content of a first pigment having the largest mean particle size in a coating layer satisfying the Equation (1) above, is less than 50 parts by mass, preferably 5 parts by mass to 45 parts by mass, both inclusive, based on 100 parts by mass of total pigments in the coating layer. By specifying the content of the first pigment having the largest mean particle size to the range above, it is possible to achieve more favorable ink fixing and ink absorption properties and inhibition of poor dot diffusion.

In the present invention, the coating layer contains as a binder a conventionally and publicly known water dispersible binder and/or water-soluble binder. As the water dispersible binder, there can be mentioned, for example, conjugated diene-based copolymer latexes such as styrene-butadiene copolymer or acrylonitrile-butadiene copolymer; acrylic copolymer latexes such as polymers of acrylic ester or methacrylic ester, or methylmethacrylate-butadiene copolymer; vinyl-based copolymer latexes such as ethylene-vinyl acetate copolymer and vinyl chloride-vinyl acetate copolymer; polyurethane resin latexes; alkyd resin latexes; unsaturated polyester resin latexes, or functional group-modified copolymer latexes in which monomers including functional groups such as carboxyl group are included in these various copolymers; or thermoset synthetic resin such as melamine resin and urea resin, but not limited to those. As the water-soluble binder, there can be mentioned, for example, starch derivatives such as oxidized starch, etherified starch, and phosphate ester starch; cellulose derivatives such as methylcellulose, carboxymethylcellulose and hydroxyethylcellulose; polyvinyl alcohol derivatives such as polyvinyl alcohol or silanol modified polyvinyl alcohol, casein, gelatin or their modified products, natural polymer resin such as soybean protein, pullulan, gum arabic, karaya gum, albumin or their derivatives; vinyl polymers such as polysodium acrylate, polyacrylamide and polyvinylpyrrolidone; sodium alginate, polyethyleneimine, polypropylene glycol, polyethylene glycol, maleic anhydride or copolymers thereof, but not limited to those.

These water dispersible binder and/or water-soluble binder can be used alone or as a mixture of two or more types. In particular, when a latex binder, which is a water dispersible binder, is used in the coating layer, the strength of the coating layer is excellent, it is therefore preferred that the coating layer of the present invention mainly contain latex binder as a binder. Here, "mainly contain latex binder as a binder" refers to containing 50 mass % or more, preferably 60 mass % or more of the total amount of binders in the coating layer.

The total content of binder(s) in the coating layer is 5 to 50 parts by mass, both inclusive, preferably 10 to 30 parts by mass, both inclusive, based on 100 parts by mass of total pigments in the coating layer, in view of the strength and ink absorption property of the coating layer.

In the present invention, commonly used coating methods can be used as the method for applying a coating layer on a base paper, and the method is not particularly limited. Various coating machines, for example, blade coaters, roll coaters, air knife coaters, bar coaters, rod blade coaters, short dwell coaters, curtain coaters and the like can be used.

While coated printing paper finished with coating can be used as it is, it is possible to smooth the surface if necessary by machine calendering, soft nip calendering, super-calendering, multistep calendering, multi-nip calendering, and the like.

If, however, excessive calendering is performed for smoothing, voids in the coated printing paper are crushed, resulting in poor ink absorption in ink jet printing and occurrence of poor dot diffusion; mild calender processing is therefore preferable.

In the other embodiments of the present invention, the surface of the coating layer has a gloss degree in which 75° gloss according to JIS Z8741 is less than 40%. By having less than 40% of 75° gloss, the gloss of what is called CWF matt coated paper for commercial printing paper can be achieved, and thus it is preferable.

In one embodiment of the present invention, when the surface of the coating layer has a gloss in which 75° gloss according to JIS Z8741 is less than 40%, the contact angle of a mixture solution (deionized water/glycerine=8/2) on the surface of the coating layer is preferably 85° to 110°, both inclusive, after 0.1 second of contact, and 65° to 90°, both inclusive, after 1.5 seconds of contact.

By limiting the contact angle to this range, the coating layer can achieve excellent ink fixing property, ink absorption property, abrasion resistance property of printed portion, or inhibition of poor dot diffusion when an ink jet printing machine is used. If the contact angle is out of the aforementioned range, the effect of the present invention cannot be achieved in some aspects of these ink jet printabilities.

In the present invention, the mixture solution of deionized water and glycerine used in the measurement of the contact angle has a mixture ratio by mass of deionized water/glycerine=8/2. Furthermore, the surface tension of the mixture solution of deionized water and glycerine is adjusted to the range of 20 mN/m to 30 mN/m, both inclusive, by the addition of an anionic fluorochemical surfactant. The ink jet ink is an aqueous solution containing a coloring material in water as a medium, and generally contains an anti-drying agent such as glycerine. Therefore, the mixture solution of deionized water and glycerine (deionized water/glycerine=8/2) used in the present invention is a solution similar to the ink jet ink used in ink jet printing machine.

In the present invention, a contact angle is determined by dropping 1 μl of droplet of the mixture solution (deionized water/glycerine=8/2) on a coating layer, and analyzing the image-data taken at a predetermined contact time period using a commercial contact angle measuring instrument. Image data analysis is performed by a curve fitting method in which computation is made assuming the shape of the droplet as a true sphere or a portion of an ellipsoid. An example of such contact angle measuring instrument, for example, is an automatic contact angle meter, CA-VP300 (manufactured by Kyowa Interface Science Co., Ltd.). In this application, 1 μl of droplet may be in the range of 1μ±20%, and as long as the droplet is in this range, there is no problem in the measurement.

"Remaining droplet volume fraction" as used herein refers to the percentage of the volume of droplet remaining on the surface of a coating layer, within a certain time range after dropping of a predetermined droplet on the coating layer, with respect to the volume of the droplet dropped, as shown in the following equation (2). Equation (2):

$$\text{Remaining droplet volume fraction (\%)}=\{(\text{Volume } V_t \text{ of droplet remaining on the surface of a coating layer after } t \text{ second(s) of dropping})/(\text{Volume of dropped droplet})\}\times 100$$

In the present invention, the remaining droplet volume fraction is the percentage of a value obtained by dividing the volume of droplet remaining on the coating layer not having been absorbed after a predetermined time of dropping of 1 μl of droplet of the aforementioned mixture solution (deionized water/glycerine=8/2) on the coating layer, by the volume of the dropped droplet. Here, the volume of the remaining droplet can be computed by applying to the following equation (3) the droplet radius and the droplet height measured from the image analysis data obtained by a commercial contact angle measuring instrument. In this application, 1 μl of droplet may be in the range of 1μ±20%, and as long as the droplet is in this range, there is no problem in the measurement.

$$V_t=\pi\times(r_t\times r_t\times h_t/2+h_t\times h_t\times h_t/6) \quad \text{Equation (3)}$$

$V_t$: volume of the droplet (μl) remaining on the surface of the coating layer, after t second(s) of dropping π: pi (circumference ratio)

$r_t$: the radius of the droplet to be measured (μm) on the surface of the coating layer after t second(s) of dropping $h_t$: the height of the droplet to be measured (μm) on the surface of the coating layer after t second(s) of dropping Examples of such contact angle measuring instrument include, for example, an automatic contact angle meter CA-VP300 (manufactured by Kyowa Interface Science Co., Ltd.).

In the coated printing paper of the present invention, the remaining droplet volume fraction with respect to 1 μl of droplet of the mixture solution (deionized water/glycerine=8/2) after 1.5 seconds of the dropping of the droplet on the surface of the coating layer, is preferably 85% to 100%, both inclusive, and after 10 seconds of the dropping, 70% to 90%, both inclusive. By limiting the remaining droplet volume fraction to this range, a more excellent ink fixing property, abrasion resistance property of the printed portion, and inhibition of poor dot diffusion can be achieved when an ink jet printing machine is used. If the remaining droplet volume fraction is out of the range of the present invention, the effect of the present invention cannot be achieved in some aspects of these ink jet printabilities.

In the present invention, adjustment of the contact angle of the coating layer or the remaining droplet volume fraction to the aforementioned respective ranges can be achieved by a technique of combining various conditions such as the amount of coating, pigment type, mean particle size of pigment, particle size distribution of pigment, shape of pigment, oil absorbency of pigment, binder type, molecular weight of binder or degree of polymerization of binder, mixing ratio of water dispersible binder to water-soluble binder, and ratio of pigment to binder.

As a method to adjust the contact angle of the coating layer or the remaining droplet volume fraction to the aforementioned respective ranges, more specifically, there are following methods: (1) combining a platy or spherical pigment with an amorphous pigment, (2) causing a pigment having a mean particle size in the range of 0.8 μm to 3.5 μm, both inclusive, to be contained in the largest ratio with respect to the total pigments, (3) causing the amorphous pigment to be contained in a high ratio, (4) causing the ratio of the binder(s) to be 6 parts by mass to 25 parts by mass, both inclusive, with respect to 100 parts by mass of pigments, (5) causing a water dispersible binder to be contained in a high ratio with respect to total binders in the coating layer, and (6) causing the mean particle size of the pigment having a fixed form to be 5 μm or less. The contact angle or remaining droplet volume fraction in the aforementioned respective ranges can be achieved by using these respective methods alone or in combination, but the methods are not limited to those. Furthermore, in an embodiment of the present invention, the mean particle size of the pigments is a mean particle size according to laser diffraction/scattering method or dynamic light scattering. For pigments having a mean particle size of 3 μm or more, the mean particle size is according to the Coulter counter method.

In the present invention, 75° gloss according to JIS Z8741 on the surface of the coating layer can be adjusted by the type and mean particle size of the pigments to be used in the coating layer. Moreover, the gloss on the surface of the coating layer can be adjusted by subjecting the coating layer to a calendering process. It is more preferred that the types of the pigments be selected from ground calcium carbonate, precipitated calcium carbonate, kaolin, synthesized amorphous silica and colloidal silica such that the contact angle or remaining droplet volume fraction of the coating layer fall in the aforementioned respective ranges and that 75° gloss according to JIS Z8741 is less than 40%. It is more preferred that the size of the mean particle size of the pigment be 0.1 μm to 5 μm, both inclusive.

In the coated printing paper of the present invention, both surfaces of the base paper can be provided with a coating layer. By providing a coating layer on both surfaces, it becomes possible to print on both surfaces by a printing machine having such function.

The finally obtained coated printing paper is subjected to a process for producing large or small size sheets of paper or a roll according to use so as to be prepared as final products. When stored, it is preferred that the paper be packed in a moisture-proof packaging to avoid moisture absorption. The basis weight of the products is not particularly limited, but is preferably about 40 to 300 g/m$^2$, both inclusive.

The coated printing paper of the present invention can be used for both offset printing and ink jet printing, and can produce a printed image having excellent image quality and durability. The coated printing paper of the present invention can also be used favorably for ink jet printing machines using pigment ink, and can produce a printed image having excellent image quality and durability. The coated printing paper of the present invention can also be used favorably for rotary-type ink jet printing machines having a printing speed of 15 m/min or more, those having a higher printing speed of 60 m/min or more, and those having a further higher speed of more than 120 m/min, and can produce a printed image having excellent image quality and durability.

It is also possible to use the coated printing paper of the present invention for gravure printing and other printing methods in addition to offset printing, and there is no limitation at all. Furthermore, it is possible to use the paper for commercial ink jet printers besides rotary-type ink jet printing machines.

As another embodiment of the present invention, provided is a method for improving the image quality and durability of printed images printed by ink jet printing machines, comprising the steps of obtaining the aforementioned coated printing paper, and forming a printed image on the coating layer of the coated printing paper by performing ink jet printing using pigment ink at a printing speed of 50 m/min or more. Furthermore, the present invention provides a method for forming a printed image free of rubbing-off, smudges, uneven absorption or bleeding of ink and white lines by ink jet printing, comprising the step of obtaining the aforementioned coated printing paper, and forming a printed image on the coating layer of the coated printing paper by performing ink jet printing using pigment ink at a printing speed of 50 m/min or more. Moreover, the present invention provides a method for forming an excellent printed image, comprising the step of obtaining the coated printing paper, and forming a printed image on the coating layer of the coated printing paper using an offset printing machine and/or ink jet printing machine.

EXAMPLE

Hereinbelow, the present invention will be more specifically explained by Examples, but the present invention will never be limited to Examples below so long as the gist is not exceeded. It should be noted that "part" and "%" shown in Examples refer to parts by mass and mass % of dry solid content or substantial components unless otherwise specifically indicated. The amount of coating also refers to the amount of coating in terms of solid content.

(Preparation 1 of Base Paper)

<Preparation of Base Paper 1>

To a pulp slurry consisting of 100 parts of LBKP (filtrated water degree 400 mlcsf) were added 12 parts of precipitated calcium carbonate as a filler, 0.8 part of amphoteric starch, 0.8 part of aluminium sulfate, 0.10 part of an alkyl ketene dimer type (hereinafter referred to as "AKD") sizing agent (SIZE PINE K903, manufactured by Arakawa Chemical Industries, Ltd.), and paper making was performed by a Fourdrinier paper machine, and to the resultant product was attached 3.0 g/m$^2$ of oxidized starch in dry attached amount and 2.5 g/m$^2$ of dimethylamine-epichlorohydrin polycondensate (Jet-Fix 5052, manufactured by Satoda Chemical Industrial Co., Ltd.) in dry attached amount as cationic resin by a size press device, followed by machine calendering process to obtain Base Paper 1 having a basis weight of 54 g/m$^2$. The ash content of the Base Paper 1 was 8.5%.

<Preparation of Base Paper 2>

Base paper 2 was prepared in the same manner as Base Paper 1 except that the blending quantity of the AKD sizing agent was changed to 0.08 part. The ash content of Base Paper 2 was 8.3%.

<Preparation of Base Paper 3>

Base Paper 3 was prepared in the same manner as Base Paper 1 except that the blending quantity of the precipitated calcium carbonate of Base Paper 1 was changed to 15 parts. The ash content of Base Paper 3 was 10.3%.

<Preparation of Base Paper 4>

Base Paper 4 was prepared in the same manner as Base Paper 1 except that the blending quantity of the precipitated calcium carbonate of Base Paper 1 was changed to 23 parts. The ash content of Base Paper 4 was 15.0%.

<Preparation of Base Paper 5>

Base Paper 5 was prepared in the same manner as Base Paper 1 except that the blending quantity of the precipitated calcium carbonate of Base Paper 1 was changed to 29 parts. The ash content of Base Paper 5 was 20.7%.

<Preparation of Base Paper 6>

Base Paper 6 was prepared in the same manner as Base Paper 1 except that the cationic resin was unused in the size press of Base Paper 1. The ash content of Base Paper 6 was 8.6%.

Preparation 1 of Coated Printing Paper

Example 1

To both surfaces of Base Paper 1 was applied a coating colour in which a pigment comprising 40 parts of primary kaolin (mean particle size of 2.2 μm), 50 parts of ground calcium carbonate (Hydrocarb 90, manufactured by Bihoku Funka Kogyo Co., Ltd, mean particle size of 0.8 μm), and 10 parts of a plastic pigment (Ropaque HP91, manufactured by Rohm and Haas Company, mean particle size of 1.0 μm); 10 parts of a styrene butadiene copolymer latex (JSR-2605G, glass transition temperature: −19° C., manufactured by JSR Corporation) as a latex binder; and 4 parts of phosphate ester starch as a water-soluble binder were blended using a blade coater such that the amount of coating on one surface was 2.0 g/m$^2$, followed by mild super-calendering process to obtain a coated printing paper of Example 1.

Example 2

The coated printing paper of Example 2 was prepared in the same manner as Example 1 except that the amount of coating of Example 1 was changed to 5.0 g/m$^2$.

Example 3

The coated printing paper of Example 3 was prepared in the same manner as Example 1 except that the amount of coating of Example 1 was changed to 7.0 g/m$^2$.

Example 4

The coated printing paper of Example 4 was prepared in the same manner as Example 1 except that Base Paper 1 of Example 1 was replaced with Base Paper 2.

Example 5

The coated printing paper of Example 5 was prepared in the same manner as Example 2 except that Base Paper 1 of Example 2 was replaced with Base Paper 2.

Example 6

The coated printing paper of Example 6 was prepared in the same manner as Example 2 except that the pigment ratio in the coating colour of Example 2 was changed to 30 parts of primary kaolin (mean particle size of 2.2 μm), 60 parts of ground calcium carbonate (Hydrocarb 90, manufactured by Bihoku Funka Kogyo Co., Ltd, mean particle size of 0.8 μm) and 10 parts of a plastic pigment (Ropaque HP91, manufactured by Rohm and Haas Company, mean particle size of 1.0 μm).

Example 7

The coated printing paper of Example 7 was prepared in the same manner as Example 2 except that the pigment ratio in the coating colour of Example 2 was changed to 20 parts of primary kaolin (mean particle size of 2.2 μm), 70 parts of ground calcium carbonate (Hydrocarb 90, manufactured by Bihoku Funka Kogyo Co., Ltd, mean particle size of 0.8 μm), and 10 parts of a plastic pigment (Ropaque HP91, manufactured by Rohm and Haas Company, mean particle size of 1.0 μm).

Example 8

The coated printing paper of Example 8 was prepared in the same manner as Example 5 except that the pigment ratio in the coating colour of Example 5 was changed to 40 parts of primary kaolin (mean particle size of 2.2 μm), 35 parts of ground calcium carbonate (Hydrocarb 90, manufactured by Bihoku Funka Kogyo Co., Ltd, mean particle size of 0.8 μm), 15 parts of ground calcium carbonate (Hydrocarb 60, manufactured by Bihoku Funka Kogyo Co., Ltd, mean particle size of 1.2 μm), and 10 parts of a plastic pigment (Ropaque HP91, manufactured by Rohm and Haas Company, mean particle size of 1.0 μm).

Example 9

The coated printing paper of Example 9 was prepared in the same manner as Example 5 except that the pigment ratio in the coating colour of Example 5 was changed to 40 parts of primary kaolin (mean particle size of 2.2 μm), 15 parts of ground calcium carbonate (Hydrocarb 90, manufactured by Bihoku Funka Kogyo Co., Ltd, mean particle size of 0.8 μm), 35 parts of ground calcium carbonate (Hydrocarb 60, manufactured by Bihoku Funka Kogyo Co., Ltd, mean particle size of 1.2 μm), and 10 parts plastic pigment (Ropaque HP91, manufactured by Rohm and Haas Company, mean particle size of 1.0 μm).

Example 10

To both surfaces of Base Paper 2 was applied a coating colour in which a pigment comprising 40 parts of primary kaolin (mean particle size 2.2 μm), 50 parts of ground calcium carbonate (Hydrocarb 60 manufactured by Bihoku Funka Kogyo Co., Ltd, mean particle size of 1.2 μm), and 10 parts of a plastic pigment (Ropaque HP91, manufactured by Rohm and Haas Company, mean particle size of 1.0 μm); 10 parts of a styrene butadiene copolymer latex (trade name: JSR-2605G, glass transition temperature: −19° C., manufactured by JSR Corporation) as a latex binder; and 4 parts of phosphate ester starch as a water-soluble binder were blended using a blade coater such that the amount of coating on one surface was 2.0 g/m$^2$, followed by mild super-calendering process to obtain a coated printing paper of Example 10.

Example 11

The coated printing paper of Example 11 was prepared in the same manner as Example 10 except that the amount of coating of Example 10 was changed to 5.0 g/m$^2$.

Example 12

The coated printing paper of Example 12 was prepared in the same manner as Example 10 except that the amount of coating of Example 10 was changed to 7.0 g/m$^2$.

Example 13

The coated printing paper of Example 13 was prepared in the same manner as Example 1 except that except that Base Paper 1 of Example 1 was replaced with Base Paper 3.

Example 14

The coated printing paper of Example 14 was prepared in the same manner as Example 2 except that Base Paper 1 of Example 2 was replaced with Base Paper 3.

Example 15

The coated printing paper of Example 15 was prepared in the same manner as Example 3 except that Base Paper 1 of Example 3 was replaced with Base Paper 3.

Example 16

The coated printing paper of Example 16 was prepared in the same manner as Example 2 except that Base Paper 1 of Example 2 was replaced with Base Paper 4.

Example 17

The coated printing paper of Example 17 was prepared in the same manner as Example 2 except that Base Paper 1 of Example 2 was replaced with Base Paper 5.

Example 18

To both surfaces of Base Paper 3 was applied a coating colour in which a pigment comprising 40 parts of primary kaolin (mean particle size of 2.2 μm), 50 parts of ground calcium carbonate (Hydrocarb 60 manufactured by Bihoku Punka Kogyo Co., Ltd, mean particle size of 1.2 μm), and 10 parts of a plastic pigment (Ropaque HP91, manufactured by Rohm and Haas Company, mean particle size of 1.0 μm); 10 parts of a styrene butadiene copolymer latex (trade name: JSR-2605G, glass transition temperature: −19° C., manufactured by JSR Corporation) as a latex binder; and 4 parts of phosphate ester starch as a water-soluble binder were blended using a blade coater such that the amount of coating on one surface was 2.0 g/m$^2$, followed by mild super-calendering process to prepare a coated printing paper of Example 18.

Example 19

The coated printing paper of Example 19 was prepared in the same manner as Example 18 except that the amount of coating of Example 18 was changed to 5.0 g/m$^2$.

Example 20

The coated printing paper of Example 20 was prepared in the same manner as Example 18 except that the amount of coating of Example 18 was changed to 7.0 g/m$^2$.

Comparative Example 1

The coated printing paper of Comparative Example 1 was prepared in the same manner as Example 1 except that the amount of coating of Example 1 was changed to 8.0 g/m$^2$.

Comparative Example 2

The coated printing paper of Comparative Example 2 was prepared in the same manner as Example 1 except that the amount of coating of Example 1 was changed to 1.0 g/m$^2$.

Comparative Example 3

The coated printing paper of Comparative Example 3 was prepared in the same manner as Example 2 except that the pigment ratio in the coating colour of Example 2 was changed to 50 parts of primary kaolin (mean particle size of 2.2 μm), 40 parts of ground calcium carbonate (Hydrocarb 90, manufactured by Bihoku Funka Kogyo Co., Ltd, mean particle size of 0.8 μm), and 10 parts of a plastic pigment (Ropaque HP91, manufactured by Rohm and Haas Company, mean particle size of 1.0 μm).

Comparative Example 4

The coated printing paper of Comparative Example 4 was prepared in the same manner as Example 2 except that Base Paper 1 of Example 2 was replaced with Base Paper 6.

(Evaluation 1 of Coated Printing Paper)

Coated printing papers of Examples 1 to 20 and Comparative Examples 1 to 4 were evaluated by the methods described below as to sheet appearance, offset printability, ink fixing property, inhibition of poor dot diffusion and abrasion resistance property. The results are shown in Table 1. Furthermore, particle size distributions of the respective ground calcium carbonate used in preparing a coating colour used for preparing coated printing papers of the aforementioned Example 1 to 20 and Comparative Example 1 to 4 were measured by the method described below. The results are shown in Table 1.

<Measurement of Particle Size Distribution of Ground Calcium Carbonate>

The particle size distributions of ground calcium carbonate blended alone or as a mixture in the coating layers were measured using a size distribution measuring instrument, Microtrac MT3000II, manufactured by Nikkiso Co., Ltd. under the following measurement conditions.

Solvent: Water

Refractive index of particle: 1.49 particles shape: aspherical

A cumulative frequency curve regarding pigment particle size based on the volume was prepared from the measurement results of particle size distribution, and the cumulative frequency of particle with the size of 2.0 μm or less was calculated using an analysis means attached to the measuring instrument.

<Evaluation of Sheet Appearance>

Sheet appearance was visually determined. The following indexes were used as the criteria of evaluation.

4: An even surface and an excellent sheet appearance as a coated paper

3: A sheet appearance equivalent to that of a matt-type coated paper

2: A sheet appearance different from non-coated paper, and the coating is recognizable.

1: A sheet appearance equivalent to non-coated paper

Papers having excellent sheet appearance clearly different from that of non-coated paper are those rated "2" or higher.

<Evaluation of Offset Printability>

Printing of 6000 m was performed using an offset form rotary press manufactured by Miyakoshi Printing Machinery Co., Ltd. under the following conditions: printing speed: 150 m/min, ink used: T&K TOKA BEST CURE UV Black ink and gold red, UV radiation value: 8 kW×2 irradiators, and after printing, the state of blanket piling and the conditions of print samples were visually determined. The following indexes were used as the criteria of evaluation.

3: Favorable properties

2: Properties in the range of no practical problem

1: Poor properties

Those rated "2" or higher are excellent in offset printability.

<Evaluation of Ink Fixing Property>

Images for evaluation were printed with pigment ink at a printing speed of 50 m/min using an ink jet printing machine MJP-600, manufactured by Miyakoshi Printing Machinery Co., Ltd., and ink smudge as a result of transfer in the portion of 200% solid image was visually determined. The following indexes were used as the criteria of evaluation.

5: No transfer smudge at all, showing favorable property

4: Very slight occurrence of transfer smudge, but generally favorable property

3: Slight occurrence of transfer smudge, but in the range of no practical problem 2: Noticeable occurrence of transfer smudge, which constitutes a problem in practical use 1: Significant occurrence of transfer smudge, indicating poor property Those rated "3" or higher are excellent in ink fixing property.

<Evaluation of Inhibition of Poor Dot Diffusion>

Images for evaluation were printed with pigment ink at a printing speed of 50 m/min using an ink jet printing machine MJP-600, manufactured by Miyakoshi Printing Machinery Co., Ltd., and the state of white lines occurred with black ink and magenta ink was visually determined. The following indexes were used as the criteria of evaluation.

5: No white lines at all, showing a good property

4: Very slight occurrence of white lines depending on the color, but generally good property 3: Slight occurrence of white lines, but in the range of no practical problem 2: Noticeable occurrence of white lines, which constitutes a problem in practical use 1: Significant occurrence of white lines, indicating poor property Those rated "3" or higher are excellent in inhibition of poor dot diffusion.

<Evaluation of Abrasion Resistance Property of Printed Portion>

Images for evaluation were printed with pigment ink at a printing speed of 50 m/min using an ink jet printing machine MJP-600, manufactured by Miyakoshi Printing Machinery Co., Ltd., and one hour after printing with black ink, a solid image portion in an image size of 18 cm×18 cm was subjected to a friction test for 25 times by pressing a cotton gauze against it with a load of 500 g or 300 g. The following indexes were used as the criteria of evaluation. Evaluation was made visually according to the following criteria. Those rated "3 to 5" in evaluation have no practical problem.

5: Almost no scar at all is observed with the load of 500 g.

4: Slight scars are observed when tested with the load of 500 g, but are acceptable level.

3: Slight scars are observed when tested with the load of 300 g, but are acceptable level.

2: Some scars are observed when tested with the load of 300 g.

1: Noticable scars are observed when tested with the load of 300 g.

Those rated "3" or higher are excellent in abrasion resistance property.

TABLE 1

| Example Comparative Example | Base paper | Base paper composition: Amount of AKD sizing agent part by mass | Base paper composition: Ash content mass % | Base paper composition: Attached amount of cationic compound g/m$^2$ | Coating layer composition: Amount of coating (one surface) g/m$^2$ | Coating layer composition: Ground calcium carbonate particle distribution Cumulative frequency of particle size ≤2.0 μm % | Coating layer composition: Blend ratio of ground calcium carbonate (with respect to total pigments) % | Evaluation Results: Sheet appearance | Evaluation Results: Offset printability | Evaluation Results: Ink fixing property | Evaluation Results: Inhibition of poor dot diffusion | Evaluation Results: Abration resistance property of printed portion |
|---|---|---|---|---|---|---|---|---|---|---|---|---|
| Example 1 | Base paper 1 | 0.10 | 8.5 | 2.5 | 2.0 | 90 | 50 | 2 | 3 | 4 | 4 | 3 |
| Example 2 | Base paper 1 | 0.10 | 8.5 | 2.5 | 5.0 | 90 | 50 | 3 | 3 | 3 | 3 | 3 |
| Example 3 | Base paper 1 | 0.10 | 8.5 | 2.5 | 7.0 | 90 | 50 | 4 | 3 | 3 | 3 | 3 |
| Example 4 | Base paper 2 | 0.08 | 8.3 | 2.5 | 2.0 | 90 | 50 | 2 | 3 | 5 | 4 | 3 |
| Example 5 | Base paper 2 | 0.08 | 8.3 | 2.5 | 5.0 | 90 | 50 | 3 | 3 | 4 | 3 | 3 |
| Example 6 | Base paper 1 | 0.10 | 8.5 | 2.5 | 5.0 | 90 | 60 | 3 | 3 | 3 | 3 | 4 |
| Example 7 | Base paper 1 | 0.10 | 8.5 | | 5.0 | 90 | 70 | 3 | 3 | 4 | 4 | 5 |
| Example 8 | Base paper 2 | 0.08 | 8.3 | 2.5 | 5.0 | 80 | 50 | 3 | 3 | 4 | 3 | 3 |
| Example 9 | Base paper 2 | 0.08 | 8.3 | 2.5 | 5.0 | 70 | 50 | 3 | 3 | 4 | 4 | 4 |
| Example 10 | Base paper 2 | 0.08 | 8.3 | 2.5 | 2.0 | 60 | 50 | 2 | 3 | 5 | 5 | 4 |
| Example 11 | Base paper 2 | 0.08 | 8.3 | 2.5 | 5.0 | 60 | 50 | 3 | 3 | 5 | 5 | 4 |
| Example 12 | Base paper 2 | 0.08 | 8.3 | 2.5 | 7.0 | 60 | 50 | 4 | 3 | 4 | 4 | 4 |
| Example 13 | Base paper 3 | 0.10 | 10.3 | 2.5 | 2.0 | 90 | 50 | 2 | 3 | 5 | 4 | 3 |
| Example 14 | Base paper 3 | 0.10 | 10.3 | 2.5 | 5.0 | 90 | 50 | 3 | 3 | 4 | 4 | 3 |
| Example 15 | Base paper 3 | 0.10 | 10.3 | 2.5 | 7.0 | 90 | 50 | 4 | 3 | 3 | 4 | 3 |
| Example 16 | Base paper 4 | 0.10 | 15.0 | 2.5 | 5.0 | 90 | 50 | 3 | 3 | 4 | 4 | 4 |
| Example 17 | Base paper 5 | 0.10 | 20.7 | 2.5 | 5.0 | 90 | 50 | 3 | 2 | 5 | 4 | 4 |
| Example 18 | Base paper 3 | 0.10 | 10.3 | 2.5 | 2.0 | 60 | 50 | 2 | 3 | 5 | 5 | 4 |
| Example 19 | Base paper 3 | 0.10 | 10.3 | 2.5 | 5.0 | 60 | 50 | 3 | 3 | 5 | 5 | 4 |
| Example 20 | Base paper 3 | 0.10 | 10.3 | 2.5 | 7.0 | 60 | 50 | 4 | 3 | 4 | 5 | 4 |
| Comparative Example 1 | Base paper 1 | 0.10 | 8.5 | 2.5 | 8.0 | 90 | 50 | 4 | 3 | 2 | 2 | 2 |
| Comparative Example 2 | Base paper 1 | 0.10 | 8.5 | 2.5 | 1.0 | 90 | 50 | 1 | 3 | 4 | 4 | 3 |
| Comparative Example 3 | Base paper 1 | 0.10 | 8.5 | 2.5 | 5.0 | 90 | 40 | 3 | 3 | 2 | 2 | 2 |
| Comparative Example 4 | Base paper 6 | 0.10 | 8.6 | 0.0 | 5.0 | 90 | 50 | 3 | 3 | 1 | 2 | 1 |

<Comparative Evaluation 1>

By comparing Examples 1 to 3 with Comparative Examples 1 to 2, it is understood that by applying a coating layer in an amount of coating per surface in the range of 2.0 g/m$^2$ to 7.0 g/m$^2$, both inclusive, on a base paper containing a cationic resin, a coated printing paper excellent in sheet appearance and also excellent in the balance of the various properties can be obtained.

By comparing Example 2 with Comparative Example 4, it is understood that by using a base paper containing a cationic resin as the base paper of the coating paper of the present invention, a coated printing paper excellent in ink fixing property, inhibition of poor dot diffusion, and abrasion resistance property can be obtained.

By comparing Examples 2, 6 and 7 with Comparative Example 3, it is understood that as a result of the fact that the coating layer of the coated printing paper of the present invention contains 50 parts or more of ground calcium carbonate based on 100 parts by mass of total pigments in the coating layer, a coated printing paper excellent in ink fixing property, inhibition of poor dot diffusion, and abrasion resistance property can be obtained.

By comparing Examples 5, 8, 9 and 11 with one another, it is understood that as a result of the fact that the coating layer of the coated printing paper of the present invention contains 50 parts or more of ground calcium carbonate having a particle size distribution where the cumulative frequency of particle with the sizes of 2 μm or less is 70% or less, based on 100 parts by mass of total pigments in the coating layer, inhibition of poor dot diffusion is particularly improved.

By comparing Examples 1 to 3 and Examples 13 to 17, it is understood that by limiting the ash content of the base paper to no less than 10%, a coated printing paper excellent in the balance between ink fixing property, inhibition of poor dot diffusion, and abrasion resistance property can be obtained.

Preparation 2 of Coated Printing Paper

Example 21

The coated printing paper of Example 21 was prepared in the same manner as Example 1 except that dimethylamine-epichlorohydrin polycondensate (Jet-Fix 5052, manufactured by Satoda Chemical Industrial Co., Ltd.) of Base Paper 1 used in Example 1 was replaced with magnesium chloride as multivalent cation salt.

Example 22

The coated printing paper of Example 22 was prepared in the same manner as Example 2 except that dimethylamine-epichlorohydrin polycondensate (Jet-Fix 5052, manufactured by Satoda Chemical Industrial Co., Ltd.) of Base Paper 1 used in Example 2 was replaced with magnesium chloride as a multivalent cation salt.

Example 23

The coated printing paper of Example 23 was prepared in the same manner as Example 3 except that dimethylamine-epichlorohydrin polycondensate (Jet-Fix 5052, manufactured by Satoda Chemical Industrial Co., Ltd.) of Base Paper 1 used in Example 3 was replaced with magnesium chloride as a multivalent cation salt.

Example 24

The coated printing paper of Example 24 was prepared in the same manner as Example 4 except that dimethylamine-epichlorohydrin polycondensate (Jet-Fix 5052, manufactured by Satoda Chemical Industrial Co., Ltd.) of Base Paper 2 used in Example 4 was replaced with magnesium chloride as a multivalent cation salt.

Example 25

The coated printing paper of Example 25 was prepared in the same manner as Example 5 except that dimethylamine-epichlorohydrin polycondensate (Jet-Fix 5052, manufactured by Satoda Chemical Industrial Co., Ltd.) of Base Paper 2 used in Example 5 was replaced with magnesium chloride as a multivalent cation salt.

Example 26

The coated printing paper of Example 26 was prepared in the same manner as Example 6 except that dimethylamine-epichlorohydrin polycondensate (Jet-Fix 5052, manufactured by Satoda Chemical Industrial Co., Ltd.) of Base Paper 1 used in Example 6 was replaced with magnesium chloride as a multivalent cation salt.

Example 27

The coated printing paper of Example 27 was prepared in the same manner as Example 7 except that dimethylamine-epichlorohydrin polycondensate (Jet-Fix 5052, manufactured by Satoda Chemical Industrial Co., Ltd.) of Base Paper 1 used in Example 7 was replaced with magnesium chloride as a multivalent cation salt.

Example 28

The coated printing paper of Example 28 was prepared in the same manner as Example 8 except that dimethylamine-epichlorohydrin polycondensate (Jet-Fix 5052, manufactured by Satoda Chemical Industrial Co., Ltd.) of Base Paper 2 used in Example 8 was replaced with magnesium chloride as a multivalent cation salt.

Example 29

The coated printing paper of Example 29 was prepared in the same manner as Example 9 except that dimethylamine-epichlorohydrin polycondensate (Jet-Fix 5052, manufactured by Satoda Chemical Industrial Co., Ltd.) of Base Paper 2 used in Example 9 was replaced with magnesium chloride as a multivalent cation salt.

Example 30

The coated printing paper of Example 30 was prepared in the same manner as Example 10 except that dimethylamine-epichlorohydrin polycondensate (Jet-Fix 5052, manufactured by Satoda Chemical Industrial Co., Ltd.) of Base Paper 2 used in Example 10 was replaced with magnesium chloride as a multivalent cation salt.

Example 31

The coated printing paper of Example 31 was prepared in the same manner as Example 11 except that dimethylamine-epichlorohydrin polycondensate (Jet-Fix 5052, manufactured by Satoda Chemical Industrial Co., Ltd.) of Base Paper 2 used in Example 11 was replaced with magnesium chloride as a multivalent cation salt.

Example 32

The coated printing paper of Example 32 was prepared in the same manner as Example 12 except that dimethylamine-epichlorohydrin polycondensate (Jet-Fix 5052, manufactured by Satoda Chemical Industrial Co., Ltd.) of Base Paper 2 used in Example 12 was replaced with magnesium chloride as a multivalent cation salt.

Example 33

The coated printing paper of Example 33 was prepared in the same manner as Example 13 except that dimethylamine-epichlorohydrin polycondensate (Jet-Fix 5052, manufactured by Satoda Chemical Industrial Co., Ltd.) of Base Paper 3 used in Example 13 was replaced with magnesium chloride as a multivalent cation salt.

Example 34

The coated printing paper of Example 34 was prepared in the same manner as Example 14 except that dimethylamine-epichlorohydrin polycondensate (Jet-Fix 5052, manufactured by Satoda Chemical Industrial Co., Ltd.) of Base Paper 3 used in Example 14 was replaced with magnesium chloride as a multivalent cation salt.

Example 35

The coated printing paper of Example 35 was prepared in the same manner as Example 15 except that dimethylamine-epichlorohydrin polycondensate (Jet-Fix 5052, manufactured by Satoda Chemical Industrial Co., Ltd.) of Base Paper 3 used in Example 15 was replaced with magnesium chloride as a multivalent cation salt.

Example 36

The coated printing paper of Example 36 was prepared in the same manner as Example 16 except that dimethylamine-epichlorohydrin polycondensate (Jet-Fix 5052, manufactured by Satoda Chemical Industrial Co., Ltd.) of Base Paper 4 used in Example 16 was replaced with magnesium chloride as a multivalent cation salt.

Example 37

The coated printing paper of Example 37 was prepared in the same manner as Example 17 except that dimethylamine-epichlorohydrin polycondensate (Jet-Fix 5052, manufactured by Satoda Chemical Industrial Co., Ltd.) of Base Paper 5 used in Example 17 was replaced with magnesium chloride as a multivalent cation salt.

Example 38

The coated printing paper of Example 38 was prepared in the same manner as Example 18 except that dimethylamine-epichlorohydrin polycondensate (Jet-Fix 5052, manufactured by Satoda Chemical Industrial Co., Ltd.) of Base Paper 3 used in Example 18 was replaced with magnesium chloride as a multivalent cation salt.

Example 39

The coated printing paper of Example 39 was prepared in the same manner as Example 19 except that dimethylamine-epichlorohydrin polycondensate (Jet-Fix 5052, manufactured by Satoda Chemical Industrial Co., Ltd.) of Base Paper 3 used in Example 19 was replaced with magnesium chloride as a multivalent cation salt.

Example 40

The coated printing paper of Example 40 was prepared in the same manner as Example 20 except that dimethylamine-epichlorohydrin polycondensate (Jet-Fix 5052, manufactured by Satoda Chemical Industrial Co., Ltd.) of Base Paper 3 used in Example 20 was replaced with magnesium chloride as a multivalent cation salt.

Comparative Example 5

The coated printing paper of Comparative Example 5 was prepared in the same manner as Comparative Example 1 except that dimethylamine-epichlorohydrin polycondensate (Jet-Fix 5052, manufactured by Satoda Chemical Industrial Co., Ltd.) of Base Paper 1 used in Comparative Example 1 was replaced with magnesium chloride as a multivalent cation salt.

Comparative Example 6

The coated printing paper of Comparative Example 6 was prepared in the same manner as Comparative Example 2 except that dimethylamine-epichlorohydrin polycondensate (Jet-Fix 5052, manufactured by Satoda Chemical Industrial Co., Ltd.) of Base Paper 1 used in Comparative Example 2 was replaced with magnesium chloride as a multivalent cation salt.

Comparative Example 7

The coated printing paper of Comparative Example 7 was prepared in the same manner as Comparative Example 3 except that dimethylamine-epichlorohydrin polycondensate (Jet-Fix 5052, manufactured by Satoda Chemical Industrial Co., Ltd.) of Base Paper 1 used in Comparative Example 3 was replaced with magnesium chloride as a multivalent cation salt.

Evaluation 2 of Coated Printing Paper

Coated printing papers of the aforementioned Examples 21 to 40 and Comparative Examples 4 to 7 were evaluated in the same methods as that of Evaluation 1 for the coated printing papers of Examples 1 to 20 and Comparative Examples 1 to 4. The results are shown in Table 2. However, although images for evaluation in Evaluation 1 were printed at a printing speed of 50 m/min using the ink jet printing machine MJP-600 manufactured by Miyakoshi Printing Machinery Co., Ltd., images for evaluation in Evaluation 2 were printed at a printing speed of 64 m/min using the ink jet printing system TruepressJet520 manufactured by Dainippon Screen MFG. Co., Ltd., and evaluations were made as to ink fixing property, inhibition of poor dot diffusion and abrasion resistance property.

TABLE 2

| | | Base paper composition | | | Coating layer composition | | | Evaluation Results | | | | |
|---|---|---|---|---|---|---|---|---|---|---|---|---|
| Example Comparative Example | Base paper | Amount of AKD sizing agent part by mass | Ash content mass % | Attached amount of multivalent cation salt g/m$^2$ | Amount of coating (one surface) g/m$^2$ | Ground calcium carbonate particle distribution Cumulative frequency of particle size ≤2.0 μm % | Blend ratio of ground calcium carbonate % | Sheet appearance | Offset printability | Ink fixing property | Inhibition of poor dot diffusion | Abration resistance property of printed portion |
| Example 21 | Base paper 1 | 0.10 | 8.5 | 2.5 | 2.0 | 90 | 50 | 2 | 3 | 4 | 4 | 3 |
| Example 22 | Base paper 1 | 0.10 | 8.5 | 2.5 | 5.0 | 90 | 50 | 3 | 3 | 3 | 3 | 3 |
| Example 23 | Base paper 1 | 0.10 | 8.5 | 2.5 | 7.0 | 90 | 50 | 4 | 3 | 3 | 3 | 3 |
| Example 24 | Base paper 2 | 0.08 | 8.3 | 2.5 | 2.0 | 90 | 50 | 2 | 3 | 4 | 4 | 3 |
| Example 25 | Base paper 2 | 0.08 | 8.3 | 2.5 | 5.0 | 90 | 50 | 3 | 3 | 3 | 3 | 3 |
| Example 26 | Base paper 1 | 0.10 | 8.5 | 2.5 | 5.0 | 90 | 60 | 3 | 3 | 3 | 3 | 3 |
| Example 27 | Base paper 1 | 0.10 | 8.5 | 2.5 | 5.0 | 90 | 70 | 3 | 3 | 4 | 4 | 4 |
| Example 28 | Base paper 2 | 0.08 | 8.3 | 2.5 | 5.0 | 80 | 50 | 3 | 3 | 3 | 3 | 3 |
| Example 29 | Base paper 2 | 0.08 | 8.3 | 2.5 | 5.0 | 70 | 50 | 3 | 3 | 4 | 4 | 4 |
| Example 30 | Base paper 2 | 0.08 | 8.3 | 2.5 | 2.0 | 60 | 50 | 2 | 3 | 5 | 5 | 5 |
| Example 31 | Base paper 2 | 0.08 | 8.3 | 2.5 | 5.0 | 60 | 50 | 3 | 3 | 4 | 4 | 5 |
| Example 32 | Base paper 2 | 0.08 | 8.3 | 2.5 | 7.0 | 60 | 50 | 4 | 3 | 4 | 4 | 5 |
| Example 33 | Base paper 3 | 0.10 | 10.3 | 2.5 | 2.0 | 90 | 50 | 2 | 3 | 4 | 4 | 3 |
| Example 34 | Base paper 3 | 0.10 | 10.3 | 2.5 | 5.0 | 90 | 50 | 3 | 3 | 4 | 3 | 3 |
| Example 35 | Base paper 3 | 0.10 | 10.3 | 2.5 | 7.0 | 90 | 50 | 4 | 3 | 3 | 3 | 3 |
| Example 36 | Base paper 4 | 0.10 | 15 | 2.5 | 5.0 | 90 | 50 | 3 | 3 | 5 | 4 | 4 |
| Example 37 | Base paper 5 | 0.10 | 20.7 | 2.5 | 5.0 | 90 | 50 | 3 | 2 | 5 | 4 | 4 |
| Example 38 | Base paper 3 | 0.10 | 10.3 | 2.5 | 2.0 | 60 | 50 | 2 | 3 | 5 | 5 | 5 |
| Example 39 | Base paper 3 | 0.10 | 10.3 | 2.5 | 5.0 | 60 | 50 | 3 | 3 | 4 | 5 | 5 |
| Example 40 | Base paper 3 | 0.10 | 10.3 | 2.5 | 7.0 | 60 | 50 | 4 | 3 | 4 | 4 | 5 |

TABLE 2-continued

| Example Comparative Example | Base paper | Base paper composition: Amount of AKD sizing agent part by mass | Ash content mass % | Attached amount of multivalent cation salt g/m$^2$ | Coating layer composition: Amount of coating (one surface) g/m$^2$ | Ground calcium carbonate particle distribution Cumulative frequency of particle size ≤2.0 μm % | Blend ratio of ground calcium carbonate % | Evaluation Results: Sheet appearance | Offset printability | Ink fixing property | Inhibition of poor dot diffusion | Abration resistance property of printed portion |
|---|---|---|---|---|---|---|---|---|---|---|---|---|
| Comparative Example 4 | Base paper 6 | 0.10 | 8.6 | 0.0 | 5.0 | 90 | 50 | 3 | 3 | 1 | 2 | 1 |
| Comparative Example 5 | Base paper 1 | 0.10 | 8.5 | 2.5 | 8.0 | 90 | 50 | 4 | 3 | 2 | 2 | 2 |
| Comparative Example 6 | Base paper 1 | 0.10 | 8.5 | 2.5 | 1.0 | 90 | 50 | 1 | 3 | 4 | 4 | 3 |
| Comparative Example 7 | Base paper 1 | 0.10 | 8.5 | 2.5 | 5.0 | 90 | 40 | 3 | 3 | 2 | 2 | 1 |

<Comparative Evaluation 2>

By comparing Examples 21 to 23 and Comparative Examples 5 to 6, it is understood that by applying a coating layer containing a multivalent metal ion salt in the range of coating amount per surface of 2.0 g/m$^2$ to 7.0 g/m$^2$, a coated printing paper excellent in sheet appearance and also excellent in the balance between the various properties can be obtained.

By comparing Examples 22 and Comparative Example 4, it is understood that by using a base paper containing a multivalent cation salt as the base paper of the coated printing paper of the present invention, a coated printing paper excellent in ink fixing property, inhibition of poor dot diffusion and abrasion resistance property can be obtained.

By comparing Examples 22, 26, and 27 with Comparative Example 7, it is understood that as a result of the fact that the coating layer of the coated printing paper of the present invention contains 50 parts or more of ground calcium carbonate with respect to 100 parts by mass of total pigments in the coating layer, a coated printing paper excellent in ink fixing property, inhibition of poor dot diffusion and abrasion resistance property can be obtained.

By comparing Examples 25, 28, 29 and 31 with one another, it is understood that as a result of the fact that the coating layer of the coated printing paper of the present invention contains 50 parts or more of ground calcium carbonate having a particle size distribution where the cumulative frequency of particle with the sizes of 2 μm or less is 70% or less, based on 100 parts by mass of total pigments in the coating layer, inhibition of poor dot diffusion is particularly improved.

By comparing Examples 21 to 23 and Examples 33 to 37, it is understood that by limiting the ash content of the base paper to no less than 10%, a coated printing paper excellent in the balance between ink fixing property, inhibition of poor dot diffusion and abrasion resistance property can be obtained.

Another preferable embodiment of the present invention will be explained by means of Examples below.

Coated printing papers were prepared according to the contents below.

(Preparation 2 of Base Paper)

<Preparation of Base Paper 7>

To a pulp slurry consisting of 100 parts of LBKP (filtrated water degree 400 mlcsf) were added 15 parts of precipitated calcium carbonate as a filler, 0.8 part of amphoteric starch, 0.8 part of aluminium sulfate, 0.03 part of AKD sizing agent (SIZE PINE K903, manufactured by Arakawa Chemical Industries, Ltd.), and paper making was performed by a Fourdrinier paper machine, and to the resultant product was attached 3 g/m$^2$ of phosphate ester starch in dry attached amount by a size press device and, followed by machine calendering process to obtain Base Paper 7 having a basis weight of 93 g/m$^2$.

<Preparation of Base Paper 8>

To a pulp slurry consisting of 100 parts of LBKP (filtrated water degree 400 mlcsf) are added 15 parts of precipitated calcium carbonate as a filler, 0.8 part of amphoteric starch, 0.8 part of aluminium sulfate, 0.03 part of AKD sizing agent (SIZE PINE K903, manufactured by Arakawa Chemical Industries, Ltd.), and paper making was performed by a Fourdrinier paper machine, and to the resultant product was attached by a size press device 3.0 g/m$^2$ and 2.0 g/m$^2$ in dry attached amount of phosphate ester starch and dimethylamine-epichlorohydrin polycondensate (Jet-Fix 5052, manufactured by Satoda Chemical Industrial Co., Ltd.) as cationic resin, respectively, followed by machine calendering process to obtain Base Paper 8 having a basis weight of 93 g/m$^2$.

<Preparation of Base Paper 9>

Base Paper 9 was prepared in the same manner as Base Paper 8 except that the amount of AKD sizing agent (SIZE PINE K903, manufactured by Arakawa Chemical Industries, Ltd.) of Base Paper 9 was changed to be 0.10 parts.

(Preparation 3 of Coated Printing Paper)

Coated printing papers of Examples 41 to 44 and of Comparative Examples 8 to 10 were prepared by the following procedures.

<Preparation of Coating colour for Coating Layer>

| | |
|---|---|
| Pigment | Number of parts blended is shown in Table 3 |
| Binder | Number of parts blended is shown in Table 3 |

Pigments and binders were blended as stated above, and the mixture was adjusted with ammonia water so as to have a pH of 9.5, and with water so as to have a Brookfield type viscosity of 200 to 600 mPa·s, and stirred well to have a coating colour for forming a coating layer.

TABLE 3

| | Body paper | Pigment in coating colour | | | | Binder in coating colour | | |
|---|---|---|---|---|---|---|---|---|
| | | A | B | C | D | A | B | C |
| Example 41 | Base paper 8 | 80 | | 20 | | 10 | 4 | |
| Example 42 | Base paper 9 | 80 | | 20 | | 10 | 4 | |
| Example 43 | Base paper 9 | 80 | | 20 | | 10 | | 4 |
| Example 44 | Base paper 9 | 80 | 9 | 11 | | 10 | 4 | |
| Comparative Example 8 | Base paper 8 | 50 | 10 | 40 | | 10 | 4 | |
| Comparative Example 9 | Base paper 9 | | | 100 | | 10 | 4 | |
| Comparative Example 10 | Base paper 7 | | | | 100 | | | 14 |
| Comparative Example 11 | (Matt-type offset printing paper) | | | | | | | |
| Comparative Example 12 | (Matt-type paper exclusive for ink jet printing) | | | | | | | |

The pigment and binder in Table 3 are specifically as follows:

Pigment A: Ground calcium carbonate (mean particle size of 1.4 μm)

Pigment B: Poly styrene-based organic hollow pigment (mean particle size of 1 μm, porosity of 55 volume %)

Pigment C: Kaolin (mean particle size of 2.2 μm)

Pigment D: Amorphous synthesized silica (mean particle size of 3.3 μm)

Binder A: Styrene butadiene copolymer (glass transition temperature: −19° C.)

Binder B: Phosphate ester starch

Binder C: Polyvinyl alcohol (degree of saponification 98%, mean degree of polymerization of 500)

<Preparation 3 of Coated Printing Paper>

To one surface of a base paper was applied a coating colour for forming a coating layer using an air knife coater, and after drying, the paper was subjected to a mild super-calendering process to obtain a coated printing paper. The amount of coating was 1 g/m$^2$ for Comparative Example 8, and, for the others, the amount of coating was 5 g/m$^2$.

The matt type offset printing paper shown in Table 3 is CWF matt coated paper "New V Matt, basis weight of 104.7 g/m$^2$ (manufactured by Mitsubishi Paper Mills Limited)", and the matt type exclusive paper for ink jet printing is "jet-script ML9084 (manufactured by Mitsubishi Paper Mills Limited)".

The evaluation of the coated printing paper was performed using the following methods.

<Measurement of Contact Angle and Remaining Droplet Volume Fraction>

Measurement of contact angles and remaining droplet volume fractions were conducted by dropping 1 μl of a mixture solution (deionized water/glycerine=8/2) on the coating layers of coated printing papers, followed by image data analysis at each predetermined contact time using an automatic contact angle meter, CA-VP300 (manufactured by Kyowa Interface Science Co., Ltd.) and an image analysis software, FAMAS (manufactured by Kyowa Interface Science Co., Ltd.). The image data analysis was performed by a curve fitting method. The mixture solution (deionized water/glycerine=8/2) used for the measurement was obtained by mixing deionized water and glycerine at a mass ratio of deionized water/glycerine=8/2, and further adding to the mixture an anionic fluorochemical surfactant (manufactured by AGC Seimi Chemical Co., Ltd., SURFLON 5-111n) to adjust the surface tension to 27.5 mN/m.

<Measurement of 75° Gloss>

The sheet gloss of the ink jet recording paper was measured according to JIS Z8741, using GM-26D digital glossmeter (manufactured by Murakami Color Research Laboratory Co., Ltd.) at an angle of incidence/reflection angle of 75°. A gloss of less than 40% would suffice as a coated printing paper having a gloss of commercial printing paper equivalent to that of CWF matt coated paper.

<Evaluation 2 of Ink Fixing Property>

Images for evaluation were printed at a printing speed of 128 m/min using a rotary type ink jet printing machine, TruepressJet520, manufactured by Dainippon Screen MFG. Co., Ltd. The printed surfaces of the coated printing papers ejected at a paper ejecting part of the printing machine were observed, and the trace of ink rub-off and degree of ink detachment were determined by visual evaluation. Those rated "3" or higher are excellent in ink fixing property.

5: No trace of ink rubbing off nor detachment of ink is observed

4: Virtually no trace of ink rubbing off nor detachment of ink is observed

3: A slight trace of ink rubbing off and a very little detachment of ink are observed 2: There is a trace of ink rubbing off and the printed matter partially looks smudged.

1: There is a trace of ink rubbing off and detachment of ink across the printed portion.

<Evaluation 2 of Abrasion Resistance Property of Printed Portion>

A solid image with a black ink of 18 cm×18 cm image size was printed on the ink jet recording papers at a printing speed of 128 m/min using a rotary type ink jet printing machine, TruepressJet520, manufactured by Dainippon Screen MFG. Co., Ltd. One hour after the printing, the printed surfaces of the coated printing papers were subjected to a friction test for 25 times by pressing a cotton gauze against them with a load of 500 g or 300 g, and visual evaluation was performed according to the criteria shown below. Those rated "3" or higher are excellent in abrasion resistance property of the printed portion.

5: Almost no scar at all is observed with the load of 500 g

4: Slight scars are observed with the load of 500 g, but are acceptable level

3: Slight scars are observed with the load of 300 g, but are acceptable level

2: Some scars are observed with the load of 300 g

1: Noticeable scars are observed with the load of 300 g

<Evaluation of Ink Adhesive Strength>

Images for evaluation were printed at a printing speed of 128 m/min using a rotary type ink jet printing machine, TruepressJet520, manufactured by Dainippon Screen MFG. Co., Ltd., and one hour after the printing, the printed surfaces of the coated printing papers were scratched with nails, and adhesive strength of the ink was evaluated by visual evaluation using a scale of 5 to 1 as shown below. Those rated "3" or higher are excellent in ink adhesive strength.

5: No detachment of ink

4: Almost no detachment of ink

3: Slight detachment but no practical problem

2: Detachment is observed to the extent that the printed matter cannot be practically used 1: Detachment easily occurs and the printed matter cannot be practically used <Evaluation 2 of Inhibition of Poor Dot Diffusion>

A solid image with a black ink of 18 cm×18 cm image size was printed on coated printing papers at a printing speed of 64 m/min using a rotary type ink jet printing machine, Truepress- Jet520, manufactured by Dainippon Screen MFG. Co., Ltd. Degree of occurrence of white lines due to poor dot diffusion of ink droplets were visually evaluated. Those rated "3" or higher are excellent in inhibition of poor dot diffusion.

5: No white lines are observed.

4: Although no white lines are observed, uneven density is observed.

3: Although no white lines are observed, slight stitching is observed.

2: Vague white lines are observed.

1: White lines are clearly observed.

<Evaluation of Ink Absorption>

Using a rotary type ink jet printing machine, Truepress-Jet520, manufactured by Dainippon Screen MFG. Co., Ltd., a solid printing at a printing speed of 128 m/min was performed on coated printing papers employing a method to create seven color solid patterns, consisting of black, cyan, magenta, yellow (each as a single color) and colors (red, green, blue) created by superimposing two colors out of the three colors of the aforementioned colors other than black, each being 2 cm×2 cm in size, and being arranged horizontally side by side with no gap inbetween. The solid portion and edge portion of each color in the printed portions were determined by visual evaluation. Those rated "3" or higher are excellent in ink absorption property.

5: No bleeding in color edge portions

4: Virtually no bleeding in color edge portions

3: While there are bleeding in color edge portions, the edge portions are clearly distinguished from one another.

2: There is no clear color edge portions, and colors are slightly moved into adjacent color portions crossing the edge portions.

1: The edges of respective colors are not recognizable and bleeding of colors into the adjacent colors are significant.

The results of measurement of these contact angles and remaining droplet volume fractions as well as the respective evaluation results are shown in Table 4.

On the other hand, Comparative Example 8 to 10 where the contact angle values and remaining droplet volume fractions of the coating layers are not in the range of the present invention cannot achieve the effect of the present invention. Furthermore, according to Comparative Examples 11 and 12, contact angle values and remaining droplet volume fractions in the case of commercial matt type offset printing papers and ink jet exclusive papers are also not in the range of the present invention, and the effect of the present invention cannot be achieved.

The invention claimed is:

1. A coated printing paper having both of ink jet printability and offset printability, said coated printing paper comprising a base paper and a coating layer which is applied to at least one surface of the base paper, wherein said base paper comprises a cationic compound and said coating layer contains a pigment and a binder as major components, said pigment having a mean particle size in the range of 0.1 μm to 5 μm, both inclusive;

wherein the coating layer contains, as a pigment, 50 parts by mass or more of ground calcium carbonate based on 100 parts by mass of total pigments in the coating layer, said ground calcium carbonate having a particle size distribution in which cumulative frequency of a particle with a size of 2 μm or less is 70% or less; and wherein an applied amount of the coating layer is 2.0 g/m$^2$ to 7.0 g/m$^2$, both inclusive, per surface.

2. The coated printing paper according to claim 1, wherein the cationic compound is a cationic resin.

3. The coated printing paper according to claim 1, wherein the cationic compound is a multivalent cation salt wherein the cation is selected from the group consisting of: magnesium, calcium, strontium, barium, nickel, zinc, copper, iron, cobalt, tin, and manganese bivalent cations; aluminum, iron, and chrome trivalent cations; titanium and zirconium quaternary cations; and a complex ion thereof.

TABLE 4

| | Contact angle measurement result (°) | | Remaining droplet volume fraction measurement result (%) | | Evaluation result | | | | | |
|---|---|---|---|---|---|---|---|---|---|---|
| | after 0.1 second | after 1.5 seconds | after 1.5 seconds | after 10 seconds | 75 degree gloss (%) | Ink fixing property | Abration resistance property of printed portion | Ink adhesive strength | Poor dot diffusion | Ink absorption property |
| Example 41 | 103 | 69 | 87 | 73 | 7 | 5 | 5 | 4 | 5 | 4 |
| Example 42 | 95 | 72 | 95 | 77 | 8 | 5 | 5 | 4 | 5 | 4 |
| Example 43 | 88 | 65 | 93 | 73 | 7 | 4 | 4 | 4 | 4 | 4 |
| Example 44 | 98 | 84 | 99 | 83 | 35 | 4 | 4 | 4 | 4 | 4 |
| Comparative Example 8 | 84 | 63 | 83 | 72 | 18 | 4 | 3 | 2 | 3 | 2 |
| Comparative Example 9 | 112 | 93 | 99 | 93 | 28 | 1 | 1 | 1 | 1 | 1 |
| Comparative Example 10 | 60 | 53 | 75 | 65 | 4 | 3 | 4 | 2 | 1 | 3 |
| Comparative Example 11 | 106 | 93 | 100 | 95 | 31 | 2 | 2 | 2 | 1 | 3 |
| Comparative Example 12 | 38 | 35 | 65 | 59 | 3 | 3 | 5 | 3 | 1 | 2 |

<Comparative Evaluation 3>

Examples 41 to 44 where the contact angle values and remaining droplet volume fractions of the coating layers are within the range of the present invention have excellent printability in ink jet printing.

4. The coated printing paper according to claim 1, wherein an ash content of the base paper is 10 mass % or more.

5. The method for forming a printed image by ink jet printing, comprising:

performing ink jet printing using a pigment ink and the coated printing paper according to claim 1 at a printing speed of 50 m/min or more.

6. The method for forming a printed image by ink jet printing, comprising:

performing ink jet printing using a pigment ink and the coated printing paper according to claim 2 at a printing speed of 50 m/min or more.

7. The method for forming a printed image by ink jet printing, comprising:

performing ink jet printing using a pigment ink and the coated printing paper according to claim 3 at a printing speed of 50 m/min or more.

8. The method for forming a printed image by ink jet printing, comprising:

performing ink jet printing using a pigment ink and the coated printing paper according to claim 4 at a printing speed of 50 m/min or more.

* * * * *